US007410001B2

(12) United States Patent
Harrall et al.

(10) Patent No.: US 7,410,001 B2
(45) Date of Patent: Aug. 12, 2008

(54) COUPLING AND SEALING TUBULARS IN A BORE

(75) Inventors: Simon John Harrall, Houston, TX (US); Neil Andrew Abercrombie Simpson, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 389 days.

(21) Appl. No.: 11/140,184

(22) Filed: May 27, 2005

(65) Prior Publication Data

US 2006/0000617 A1 Jan. 5, 2006

Related U.S. Application Data

(63) Continuation-in-part of application No. 10/616,061, filed on Jul. 9, 2003, now Pat. No. 7,077,210, and a continuation-in-part of application No. 10/428,211, filed on May 2, 2003, now Pat. No. 7,086,480.

(30) Foreign Application Priority Data

May 29, 2004 (GB) ..... 0412131.5

(51) Int. Cl.
*E21B 17/08* (2006.01)

(52) U.S. Cl. ..... 166/380; 166/207; 166/242.6

(58) Field of Classification Search ..... 166/380, 166/207, 242.6, 206
See application file for complete search history.

(56) References Cited

U.S. PATENT DOCUMENTS

| | | | | |
|---|---|---|---|---|
| 5,833,001 | A | 11/1998 | Song et al. | |
| 6,431,282 | B1 | 8/2002 | Bosma et al. | |
| 6,561,227 | B2 | 5/2003 | Cook et al. | |
| 6,695,067 | B2 | 2/2004 | Johnson et al. | |
| 6,725,917 | B2 | 4/2004 | Metcalfe | |
| 6,725,918 | B2 | 4/2004 | Gano | |
| 6,742,591 | B2 | 6/2004 | Metcalfe | |
| 6,749,026 | B2 * | 6/2004 | Smith et al. | 166/313 |
| 6,942,029 | B2 * | 9/2005 | Simpson | 166/207 |
| 7,073,599 | B2 * | 7/2006 | Smith | 166/380 |
| 7,077,210 | B2 | 7/2006 | MacKay et al. | |
| 7,100,685 | B2 | 9/2006 | Cook et al. | |
| 7,108,061 | B2 * | 9/2006 | Cook et al. | 166/207 |
| 7,140,444 | B2 | 11/2006 | Mackay | |
| 7,152,684 | B2 | 12/2006 | Harrall et al. | |
| 7,182,142 | B2 | 2/2007 | Metcalfe | |

(Continued)

FOREIGN PATENT DOCUMENTS

| | | |
|---|---|---|
| FR | 2741907 | 11/1995 |

(Continued)

OTHER PUBLICATIONS

International Search Report for International Application No. PCT/GB03/02930 dated Feb. 23, 2003.

*Primary Examiner*—Hoang Dang
(74) *Attorney, Agent, or Firm*—Patterson & Sheridan, L.L.P.

(57) ABSTRACT

A method of sealing an expandable tubular within a bore comprises the steps of providing an expandable tubular describing a first diameter and having a sealing medium on its outer surface, running the tubular into a bore and expanding the tubular within the bore to describe a second larger diameter, and activating the sealing medium to facilitate provision of a seal between the tubular and the bore.

20 Claims, 13 Drawing Sheets

U.S. PATENT DOCUMENTS

| | | | |
|---|---|---|---|
| 7,195,064 | B2 | 3/2007 | Cook et al. |
| 7,213,643 | B2 | 5/2007 | Chen et al. |
| 7,219,745 | B2 | 5/2007 | Mackay |
| 7,234,531 | B2 | 6/2007 | Kendziora et al. |
| 2003/0145992 | A1 | 8/2003 | Corre et al. |
| 2004/0055758 | A1 | 3/2004 | Brezinski et al. |
| 2004/0055760 | A1 | 3/2004 | Nguyen |

FOREIGN PATENT DOCUMENTS

| | | |
|---|---|---|
| FR | 2 741 907 | 6/1997 |
| GB | 2 345 308 | 7/2000 |
| WO | WO 99/35368 | 7/1999 |
| WO | WO 02/35058 | 5/2002 |
| WO | WO 02/086286 | 10/2002 |
| WO | WO 03/006788 | 1/2003 |
| WO | WO 03/042487 | 5/2003 |
| WO | WO 03/048521 | 6/2003 |
| WO | WO 03/071086 | 8/2003 |
| WO | WO 03/104601 | 12/2003 |
| WO | WO 2004/011776 | 2/2004 |
| WO | WO 2004/027200 | 4/2004 |
| WO | WO 2004/027205 | 4/2004 |
| WO | WO 2004/048750 | 6/2004 |
| WO | WO 2004/081346 | 9/2004 |
| WO | WO 2004/085790 | 10/2004 |
| WO | WO 2004/089608 | 10/2004 |
| WO | WO 2004/092527 | 10/2004 |
| WO | WO 2004/092528 | 10/2004 |
| WO | WO 2004/094766 | 11/2004 |

* cited by examiner

COUPLING AND SEALING TUBULARS IN A BORE

CROSS-REFERENCE TO RELATED APPLICATIONS

This application is a continuation-in-part of U.S. patent application Ser. No. 10/616,061, filed Jul. 9, 2003 now U.S. Pat. No. 7,077,210, which claims priority to Great Britain patent application number 0215918.4, filed Jul. 10, 2002, and this application is also a continuation-in-part of U.S. patent application Ser. No. 10/428,211, filed May 2, 2003 now U.S. Pat. No. 7,086,480, which claims priority to Great Britain patent application number 0210256.4 filed May 3, 2002. This application is being filed concurrently with U.S. patent application Ser. No. 11/139,924, filed May 27, 2005. This application also claims priority to Great Britain patent application number 0412131.5, filed May 29, 2004, which applications are herein incorporated by reference.

FIELD OF INVENTION

The present invention relates to a method of sealing a tubular within a bore, and in particular, but not exclusively, to a method of sealing an expandable tubular body within a well bore. The present invention also relates to a method of coupling tubulars, and in particular, but not exclusively, to a method of coupling tubulars within a well bore.

BACKGROUND OF INVENTION

Extracting hydrocarbons from subterranean formations requires a bore to be formed which extends from surface to intercept the formation. Such bores, when drilled, must be supported to prevent collapse, and sealed to prevent loss of fluid, such as drilling mud or hydrocarbons or the like, into the surrounding rock, or to prevent produced fluid from flowing to surface via an unintended flow path. This is conventionally achieved by providing lengths or "strings" of tubulars which are run into and cemented in place within the bore. Such bore-lining tubulars are generally referred to as casing or liner.

In conventional bore drilling operations, a bore is drilled to a depth of around, for example, 600 meters, when the drill bit and associated drill string is removed and a string of bore-lining tubing is run in. To secure and seal the tubing string within the bore a cement slurry is pumped down through the tubing string and back up into the annulus formed between the tubing and the bore wall. The cement then sets to secure and seal the bore. Drilling is recommenced for a further 600 meters, for example, following which a further tubing string is required to be cemented in place within the bore. This procedure is repeated until the bore reaches or nears the required total depth. Conventionally, each string of tubing extends back to, and is supported or hung from surface. Once the final drilling stage is completed the drilling string is pulled out of the hole and the final bore section is supported by a tubing, generally termed a liner, which does not extend back to the wellhead, but instead terminates downhole and is supported by the previous full string of tubing or casing. The support is provided by a liner hanger, as discussed in more detail below. The liner is also cemented within the bore.

Recent developments in the oil and gas exploration industry utilise expandable bore-lining tubing which enables "mono-bore" wells to be created. That is, tubing may be run into a newly drilled or "open" hole and positioned to overlap the lower end of existing bore-lining casing or liner. The newly positioned tubing is then radially expanded to an inner diameter substantially equal to that of the existing casing or liner, thus creating the so-called "mono-bore". The existing casing or liner at its lower end supports each new tubing string.

As mentioned above, a liner hanger is utilised to secure a new tubing string to an existing tubing string within a bore. It is known in the art to establish such a liner hanger when utilising expandable tubing by radially expanding a portion of the new tubing into engagement with the lower end of the existing casing to create an interference coupling. However, in any such deformation of metallic tubing, there is a degree of elastic recovery which may prevent the desired degree of interference engagement being achieved, resulting in the creation of an ineffective liner hanger.

Due to the increasing utilisation of expandable casing and liner tubulars, various considerations must be observed to ensure that such expandable tubulars are properly cemented within the bore and that effective liner hangers, as required, are achieved. It is difficult to expand tubulars after a cementing operation, due to the expansion forces that would be required. Furthermore, expanding set cement will crack the cement, resulting in a loss of sealing function. If a casing string, for example, is required to be expanded after the cement slurry has been pumped into the annulus, care must be taken to ensure that the expansion operation is complete before the cement sets. It has been proposed, however, to utilise a cement which maintains a greater degree of compressibility than conventional cements once set. Furthermore, it is known to utilise apparatus which excludes cement from the area surrounding a portion of the tubular to be expanded. Such an apparatus is disclosed in Applicant's international patent application publication number WO02/25056, the disclosure of which is incorporated herein by reference. Otherwise, the bore-lining casing or liner must be cemented after expansion. However, cementing after expansion may also be difficult due to the reduced area of the annulus which may prevent the cement slurry from fully flowing around the exterior of the tubular, thus not properly sealing the tubular in the well bore. Additionally, the reduced annulus area may prevent or at least restrict the upward passage of fluid which generates the requirement for ports to be provided so that any fluid within the annulus may be displaced by the cement that is injected into the annulus.

It is among the objects of embodiments of the present invention to obviate or at least mitigate one or more of the above noted problems.

SUMMARY OF INVENTION

According to a first aspect of the present invention, there is provided a method of sealing an expandable tubular within a bore, said method comprising the steps of:

providing an expandable tubular describing a first diameter and having a sealing medium on the outer surface thereof;

running said tubular into a bore and expanding the tubular within the bore to describe a second larger diameter; and activating the sealing medium to facilitate provision of a seal between the tubular and the bore.

The method according to the first aspect may therefore be used to eliminate or at least minimise the requirement to use conventional cement to provide a seal between the tubular and the bore. In other aspects of the invention it may not be necessary to provide a seal between the tubular and the bore, for example where the tubular is only temporary or is only required to provide physical support for the bore wall. In such aspects of the invention the sealing medium may be replaced by a medium capable of expansion into contact with the bore wall, but which does not necessarily create a seal.

The tubular may be expanded by any appropriate method, including by means of an expansion cone or mandrel, or alternatively by a roller expansion tool such as that described in Applicant's international patent application publication numbers WO 00/37766, WO00/37772, or WO03/048503, the disclosures of which are incorporated herein by reference. The roller expansion tool may be fixed or compliant. Alternatively, or in addition, hydraulic pressure may be utilised to expand the tubular, which pressure may be applied directly to the tubular by a fluid, by means of an inflatable bladder, or by some other means.

Advantageously, the sealing medium may be a material which swells or expands in response to a stimulant. The sealing medium may be, for example, an elastomer or other resilient or compressible material which may be expanded upon activation to conform to the shape of the bore wall to provide a sufficient seal. It is known to provide swelling elastomers on downhole tubulars, a swelling elastomer absorbing liquid in the bore such that the elastomer increases in volume, and such materials may be utilised in embodiments of the present invention. However, with such swelling elastomers it may be difficult to control the degree and nature of the swelling, for example an elastomer sleeve may swell longitudinally rather than or as well as radially, particularly if radially restrained. Thus, rather than expanding radially to form a seal with a surrounding bore wall, the elastomer may tend to swell longitudinally, and as such may interfere with other components or operations. Furthermore, swelling of the elastomer is typically accompanied by a loss of mechanical strength, compromising the ability of the elastomer to provide a pressure-resistant seal, although such disadvantages may be overcome to an extent by providing a swelling elastomer that includes an element that sets or cures in the expanded condition, which curing may be induced by, for example, exposure to elevated temperature or selected fluids. In other embodiments the elastomer may incorporate structural elements. Accordingly, in preferred embodiments of the present invention the activation of the sealing medium results in a chemical reaction which provides a positive increase in volume, without significant loss of strength, structure and seal capacity.

The sealing medium may be activated upon contact with a fluid within the annulus between the tubular and the bore wall. For example, the sealing medium may be activated upon contact with hydrocarbons or drilling fluid such as oil or water-based drilling mud or the like, or may be activated by a cement slurry, for example. Alternatively, a chemical agent injected into the annulus may activate the sealing medium. In other embodiments the sealing medium may be a bi-component or multi-component material activated by mixing or contact between the components of the material, or simply by application of heat or the presence of a reaction initiator. Such activation may be as a result of the physical expansion of the tubular, by exposure to heat from expansion of the tubular or from the elevated ambient temperatures experienced downhole, or by an encapsulating material dissolving on exposure to ambient or selected downhole fluids. Other heat sources may include a heater, materials which react exothermically, or a supply of hot fluid from surface or deeper in the bore Advantageously, the sealing medium may be activated by heat produced in the working of the metal of the tubular during the expansion process. Alternatively, the sealing medium may be activated in response to some other stimulant such as pressure or an electrical current or the like. The sealing medium may be of a compressible material. This arrangement would be particularly advantageous where the tubular is cemented within the bore prior to expansion, that is cement slurry is injected into the annulus prior to expansion. Thus, the compressible sealing medium would become compressed between the cement and the outer wall of the tubular during expansion, which would result in improving the seal of the tubular within the bore. Thus, the method of the present invention may involve the step of injecting a cement slurry into the annulus formed between the tubular and well bore. The cement slurry may be injected prior to any expansion of the tubular, or alternatively after at least partial expansion of the tubular. The expansion of the tubular may take place while the fluidity of the cement slurry is maintained, after the expiry of the fluidity time, or after the fluidity of the cement slurry has decreased at least in part. In certain embodiments of the invention the sealing medium may be combined with cement slurry, for example mixed with the slurry, in addition or as an alternative to providing a sealing medium on the tubular. The sealing medium may take the form of granules or particles of swelling elastomer, mixed with a slurry of flexible cement.

The sealing medium may absorb water from cement slurry, as the cement sets, and swell as a result. Thus, the swelling sealing medium may compensate for the reduction in volume of the cement as the cement sets.

In one embodiment of the present invention, the sealing medium may activate or react with a fluid located within the annulus between the tubular and the bore wall to cause the fluid to set or harden and thus provide or assist in provision of a seal. The fluid may be composed of hydrocarbons or drilling fluid or the like or may alternatively be a cement slurry or a chemical agent injected into the annulus.

The sealing medium may be located along the entire length of the tubular. Alternatively, the sealing medium may be located on discrete or selected portions of the tubular which correspond to areas where sealing will be required when the tubular is located and expanded within the bore in order to provide, for example, zonal isolation.

The sealing medium may be in the form of a sleeve, or may be in the form of one or more collars, and the form of the sealing medium may be retained following activation. Alternatively, the form of the sealing medium may change. The sealing medium may initially be contained within a sleeve or other form and subsequently released. In one embodiment, the sealing medium may initially take the form of a centraliser. On activation, the centraliser may expand. The general form of the centraliser may be retained, or the material of the centraliser may take a different form following activation. For example, the centraliser may be formed of a material which dissolves or reacts and then flows or expands to the sealing configuration. In other embodiments the sealing medium may comprise one or more members which are released or urged towards a sealing configuration following activation. For example, a sealing member may be provided in the form of a swab cup or the like, which is biased towards an extended sealing configuration but which is retained in a retracted configuration until activation. The sealing member may be retained in a retracted configuration by an appropriate retaining member which breaks, dissolves or stretches. The sealing members may be configured to withstand or hold pressure from a particular direction. In another embodiment the sealing member may comprise an element which is activated by magnetic or electromagnetic stimulus, for example by passage of a magnetic tool through the tubular. The sealing element may take the form of a member which moves or pivots, or may comprise a flowable material which adopts a different form on exposure to appropriate stimulus.

Preferably, the bore is a well bore, and more preferably a well bore for use in the extraction of hydrocarbons from an underground formation.

The tubular may be a single tube or pipe or the like or may alternatively comprise a string of tubes or pipes or the like connected together, end to end. Advantageously, the tubular may be a casing string or alternatively a liner string. In other embodiments the tubular may include sandscreen or completion components, which components may or may not be expandable.

According to a second aspect of the present invention, there is provided an expandable tubular adapted to be located within a bore, said tubular having an activatable sealing medium on the outer surface thereof.

Preferably, the sealing medium is adapted to be activated in reaction to a specific stimulant such as a chemical stimulant or the application of heat and/or pressure. In other embodiments, the sealing medium may be initially restrained and adapted to adopt an extended sealing configuration on or following activation.

Thus, when the tubular is located in a bore, the sealing medium may be activated to form a seal, or facilitate formation of a seal, between the tubular and a bore wall.

In one embodiment, the sealing medium may act as a reactant to cause a fluid body to solidify, for example, to cause a well bore fluid such as hydrocarbons, drilling mud, a cement slurry or the like to solidify or cure. Other embodiments may include selected ones of the various preferred and alternatives features as described above with reference to the first aspect of the present invention.

According to a third aspect of the present invention, there is provided a tubular for use in a bore, the tubular comprising an expandable body portion defining an inner diameter and an outer diameter, wherein the body portion is adapted to be expanded to increase the inner diameter while substantially maintaining the outer diameter.

Preferably, the body portion of the tubular is further adapted to be expanded to increase the inner diameter and the outer diameter simultaneously. For example, the inner and outer diameter may be capable of being expanded simultaneously until a pre-selected condition is achieved, at which point the inner diameter is capable of being expanded while maintaining the outer diameter. In another embodiment, the inner diameter may be capable of being increased while maintaining the outer diameter substantially constant, and then both the inner and outer diameters may be increased simultaneously.

Advantageously, the tubular is adapted to be expanded by roller expansion, swaged expansion, hydraulic pressure or the like.

Preferably, the body portion comprises an inner wall member defining an inner diameter of the body portion, and an outer wall member defining an outer diameter of the body portion, wherein the inner and outer wall members are separated by an annular space defined therebetween. Advantageously, the inner and outer wall members are concentrically aligned. Alternatively, the wall members are eccentrically aligned.

The wall members may have different material properties. In one embodiment the outer wall member may have a lower yield strength than the inner wall member or be otherwise more readily deformable than the inner wall member, for example the outer wall member may be relatively thin. This assists in ensuring that the outer wall member will expand in preference to a portion of the inner wall that is not subject to an expansion force. In other embodiments, the properties may be reversed, to ensure an interference coupling between the expanded wall members.

The material utilised to form a part of the body portion may have a relatively high strength compared to other parts of the tubular, as the material thickness at the body portion may be less than other parts of the tubular.

In one embodiment of the present invention, the body portion of the tubular may extend over substantially the entire length thereof. In this arrangement, the inner and outer wall members may be secured to each other, for example at one or both ends of the tubular, or alternatively, or indeed additionally, at any intermediate point between the ends of the tubular. The inner and outer wall members may be welded together. Alternatively, or additionally, an annular plate may be interposed between the wall members and secured thereto, for example, by welding or the like. Alternatively, or additionally, the inner and outer wall members may be secured by generally radially extending web structures extending therebetween.

In an alternative embodiment of the present invention, the body portion of the tubular extends partially over the length of the tubular. In this embodiment, the inner wall member defines part of the inner surface of the tubular, and the outer wall member defines part of the outer surface of the tubular. The inner diameter of the body may be substantially equal to the inner diameter of the remaining length of the tubular. In this way, a tubular having a substantially uniform internal diameter is provided.

The inner and outer wall members of the body portion may be integrally formed with the tubular. Alternatively, the inner wall member may be integrally formed with the tubular, and the outer wall member may be separately formed and subsequently secured to the outer surface of the tubular or inner wall member, for example, by welding or the like. Alternatively further, the outer wall member may be integrally formed with the tubular, and the inner wall member may be formed separately and subsequently secured to the inner surface of the tubular or outer wall member. In a further alternative, both the inner and outer wall members may be separately formed and secured to the tubular. In a still further alternative, the inner and outer wall members may be integrally formed to form the body portion, with the body portion being secured to the tubular.

Preferably, where the body portion extends partially over the length of the tubular, the outer diameter of the body portion is greater than the outer diameter of the remaining length of the tubular. Thus, the outer surface of the tubular defines a non-uniform outer diameter and may be described as having a belled form.

Preferably also, the body portion of the tubular is located at an end portion thereof.

Preferably, the annular space contains means for allowing the inner and outer wall members to be expanded simultaneously. The aforementioned means may be, for example, an annular structure or one or more webs or the like extending between the wall members, such that radial forces applied to the inner wall member during an expansion process may be transmitted to the outer wall member. Advantageously, the structure or webs or the like within the annular space may be adapted to collapse or buckle when subjected to a predetermined force. Thus, if during an expansion process the outer wall member becomes restricted preventing further expansion, for example by contacting a bore wall, the force applied on the structure or webs or the like between the inner and outer wall members will accordingly increase, and upon reaching the predetermined level, will collapse. This will allow the inner wall member to be further expanded while the outer diameter of the outer wall member remains substantially unchanged. The structure or webs may take any appropriate form, and may be provided by a foamed material. In other embodiments the annular space may be filled with a deformable or flowable material such as an elastomer or a very viscous fluid, which may be displaced on experiencing a predetermined pressure.

In other embodiments the annular space may accommodate a structural member adapted to allow the diameter of the inner wall to be increased to a predetermined degree without increasing the diameter of the outer wall, and then allows any increase in diameter of the inner wall to be transmitted to the outer wall, to provide a corresponding increase in diameter. This may be useful in allowing an initial deformation of the inner wall to be achieved relatively easily. Other arrangements may permit other sequences of deformation. Of course these effects may be achieved by means other than structural members located in an annular space.

Advantageously, the annular space defined between the inner and outer wall members is closed to form an annular chamber. This may be achieved by, for example, securing together end regions of the wall members and/or through the use of an annular ring or cap secured by welding or the like to respective end portions of the wall members. In this particular embodiment the annular chamber may be at least partially filled with a fluid such as mineral oil or other substantially incompressible fluid, for example. The presence of fluid in the chamber provides the means to expand the outer wall member upon expansion of the inner member. That is, as the inner wall member is expanded with an expansion tool, such as a roller or cone expansion tool, the fluid will transmit the radial expansion forces to the outer wall member which will accordingly also be expanded.

Preferably, the body portion further comprises discharge means to allow the fluid to be discharged from the chamber. The discharge means may be one or more pressure ports or valves such as non-return valves, burst valves or the like. Preferably, the discharge means is adapted to allow fluid to be discharged from the chamber when a predetermined fluid pressure is attained during an expansion process. Thus, if during an expansion process the outer wall member becomes circumferentially restrained, for example by contact with a bore wall, the fluid pressure within the chamber will increase until the predetermined pressure level of the discharge means is reached, at which point the discharge means will allow the fluid to be vented from the chamber. Once the fluid has been discharged, further expansion of the inner wall member will be achievable, collapsing the chamber while substantially maintaining the outer diameter of the outer wall member, or more particularly without requiring further expansion of the outer wall member.

Various forms of discharge means may be provided, to ensure that further expansion of the inner wall member is achievable if, for example, a primary pressure release valve fails to open. For example, one or both of the wall members may include areas of weakness which are adapted to fail and allow discharge from the chamber above a predetermined pressure.

Conveniently, the predetermined discharge pressure of the discharge means is less than the maximum expansion pressure achievable utilising known expansion tools, such as a roller, mandrel or cone expansion tool, or by hydraulic pressure expansion apparatus, for example.

When the body portion is located at an end portion of the tubular and the inner wall is adapted to be expandable into the annular space, the resulting expanded tubular includes a belled end, wherein at least the inner diameter and possibly also the outer diameter of the expanded body portion are larger than the respective inner and outer diameters of the remaining length of the tubular. The ability to form such a shape is advantageous and has particular application where a further tubular, such as a liner string, is required to be hung from or supported by the tubular. That is, the body portion of the present invention may be used to establish a liner hanger to couple two lengths of tubular. In this case the further tubular may be expanded into the belled end of the tubular so that the resulting internal bore defined by both tubulars is substantially uniform. The body portion is preferably longer than the intended length of the overlap between the tubulars. This may be useful if the further tubular cannot be run into the bore to the desired depth, such that the overlap is longer than anticipated.

Additionally, the ability to increase the inner diameter of the body portion of the tubular while substantially maintaining the outer diameter is advantageous in that the inner diameter may be expanded or increased in situations where the outer diameter is restrained or prevented from expanding. For example, where the tubular is located in a bore and cemented in place using conventional cement, radial expansion of the outer surface of the tubular will be extremely restricted if not impossible, whereas the inner surface of the body portion of the tubular will be capable of being expanded.

In an alternative embodiment of the present invention, the annular chamber may be filled with a compressible fluid such as air or other suitable gas such that expansion of the inner wall member may be achieved without causing the outer wall member to be expanded, at least not to the same degree as the inner wall member. Alternatively, the chamber may be evacuated.

Preferably, the tubular is a bore lining tubular for use in a wellbore, and in particular a hydrocarbon production/exploration well bore. Preferably also, the tubular is expandable. The tubular may include lengths of sandscreen or completion components, which may or not be expandable.

According to a fourth aspect of the present invention, there is provided a method of expanding a tubular within a bore, the method comprising the steps of:

providing a tubular having an expandable body portion defining an inner and outer diameter;

locating the tubular within a bore; and expanding the inner diameter of the body portion while substantially maintaining the outer diameter.

Preferably, the tubular is of the form according to the third aspect noted above.

The method may also comprise the further step of expanding the inner and outer diameters of the body portion of the tubular simultaneously, typically prior to expanding the inner diameter while substantially maintaining the outer diameter.

Advantageously, the method may comprise the additional step of cementing the tubular within the bore. This cementation may be achieved before or after any expansion of the body portion.

Expansion of the body portion may be achieved using any appropriate means, including a roller expansion tool, a cone or mandrel expander, or hydraulic pressure.

According to a fifth aspect of the present invention, there is provided a method of lining a bore, said method comprising the steps of:

locating a first tubular defining a first diameter within a bore;

expanding the first tubular to define a second diameter;

further expanding a lower portion of the first tubular to define a third diameter;

locating a second tubular defining a diameter less than the second diameter within the bore such that a portion of the second tubular overlaps the lower portion of the first tubular;

expanding the second tubular into engagement with the lower portion of the first tubular; and further expanding at least part of the second tubular overlapping the lower portion of the first tubular.

Thus, expansion of the lower portion of the first tubular to define the third diameter may accommodate initial expansion of the second tubular, typically an upper portion of the second tubular, such that initial expansion of the second tubular may be achieved without requiring simultaneous expansion of the first tubular. This specific arrangement thus allows the upper portion of the second tubular to be initially expanded with the application of a considerably lower radial expansion force than would otherwise be required if initial expansion of the second tubular also required the simultaneous expansion of the lower portion of the first tubular.

It will be understood by those of skill in the art that the terms "upper" and "lower" as used herein refer to the relative locations of the ends of the tubulars in use, and are not intended to be limiting, for example the invention encompasses tubulars provided in horizontal bores and vertical or inclined bores in which the second tubular is located above the first tubular. The terms "upward" and "downward" will be understood accordingly.

The method according to the fifth aspect may further include the step of circulating or injecting cement into an annulus formed between the first tubular and the bore wall. The cement may be injected before or after the first tubular is expanded. For example, the cement may be injected before any expansion of the first tubular has taken place. Alternatively, the cement may be injected after initial expansion of the first tubular. In a preferred embodiment, the cement is injected into the annulus after the lower end of the tubular has been expanded to define the third diameter, but before the second tubular is run into the bore. In one embodiment, expansion may be commenced before the cement has set. Alternatively, expansion may commence after the cement has set. As used herein, the term "cement" is intended to encompass any settable material.

In one embodiment, the annulus between the bore wall and the lower portion of the first tubular may be substantially filled with a compressible material, such as a compressible cement, which will accommodate expansion of the lower portion, while sealing the bore.

Advantageously, cement may be excluded at least partially from a volume surrounding the lower portion of the first tubular, at least until the lower portion of the first tubular has been expanded to define the third diameter. Cement exclusion may be achieved by the use of a specifically adapted expandable tubing shoe or tubular portion which includes cement exclusion means for preventing or restricting cement access to the area around the lower portion of the first tubular. Such an arrangement is disclosed in Applicant's international patent application publication number WO02/25056, the disclosure of which is incorporated herein by reference.

The lower end of the first tubular may comprise an expandable body portion defining an inner diameter and an outer diameter, wherein the body portion is adapted to be expanded to increase the inner diameter while substantially maintaining the outer diameter. In this way, the inner diameter of the lower portion of the first tubular may be expanded when the outer diameter is circumferentially, or radially, restrained, by cement, the bore wall, which may be defined by a further tubular or the wall of a drilled bore, or the like. The first tubular may be a tubular according to the third aspect.

The method may further comprise the step of injecting cement into an annulus between the second tubular and the bore wall. The cement may be injected before or after expansion of the second tubular. Additionally, where cement slurry is injected into the annulus before expansion, expansion may be commenced before the cement has set, after the cement has set, or when the cement has partially set. As with the other aspects of the present invention, the method may be utilised in combination with compressible or flexible cement.

The first and second tubulars may be expanded by any appropriate expansion tool or method, such as an expansion cone or mandrel, a roller expansion tool such as that described in Applicant's international patent applications publication numbers WO00/37766, WO00/37772, or WO03/048503, which roller tools may be of fixed diameter or compliant, or by appropriate application of hydraulic pressure. Advantageously, where cementation of the first tubular has taken place prior to expansion of the lower portion thereof to define a third diameter, a compliant expansion tool is preferably used.

In one embodiment of the present invention, the first tubular may be located in a bottom or end portion of the bore, with the method further comprising the step of extending the depth of the bore by drilling, and running the second tubular into the extended portion of the bore. The second tubular may be run in following the drilling operation, or the second tubular may have formed the support for the drill bit. Alternatively, the bore may be of a depth to accommodate both first and second tubulars prior to running in the first tubular.

Advantageously, the method further comprises the steps of:

expanding a lower end of the second tubular to substantially define the third diameter;

locating a third tubular defining a diameter less than the second diameter within the bore such that a portion of the third tubular overlaps the lower portion of the second tubular;

expanding the third tubular into engagement with the lower portion of the second tubular; and further expanding the third tubular and lower portion of the second tubular.

According to a sixth aspect of the present invention, there is provided a method of coupling tubulars within a bore, said method comprising the steps of:

locating a first tubular having an inner diameter within a bore;

locating an expandable second tubular within the bore such that at least a portion of the second tubular extends below the first tubular;

expanding said portion of the second tubular to define an expanded portion having an outer diameter greater than the inner diameter of the first tubular; and translating the second tubular relative to the first tubular to move at least part of the expanded portion into the lower portion of the first tubular to expand said lower portion and create an interference coupling therebetween.

Thus, the interference coupling creates a tubular hanger such that the second tubular is coupled to, and is supported by, the first tubular.

A somewhat similar arrangement is disclosed in applicant's WO 03/09367, the disclosure of which is incorporated herein by reference. However, in WO 03/09367 the preferred arrangement is intended for creating a coupling between an expanded tubular and a previously cemented and thus unexpandable tubular. Furthermore, in WO 03/09367 the illustrated embodiment features an expandable tubular form which is adapted to be elastically deformed when translated into the existing non-expandable tubular.

In a preferred embodiment of the present invention the second tubular is expanded such that the second tubular has an inner diameter corresponding to the inner diameter of the first tubular. Thus, the tubulars will provide a "monobore", that is a section of bore lined with tubulars of substantially constant inner diameter.

Preferably, the second tubular is initially cylindrical. Thus, the second tubular may take the form of a substantially conventional downhole tubular. Alternatively, at least said portion of the second tubular may be non-cylindrical.

As noted above, the lower portion of the first tubular is expanded by translating the second tubular relative to the first tubular and by use of the expanded portion of the second tubular as an expansion device. Thus, assuming that appropriate materials have been selected, the inherent elastic recovery of the resulting expanded lower portion of the first tubular will act to grip the second tubular, thus creating an enhanced interference coupling. The lower portion of the first tubular is preferably plastically expanded, that is subject to permanent deformation.

Applicant's WO 03/048521, the disclosure of which is incorporated herein by reference, describes the importance of appropriate material selection where load-bearing or sealing couplings are to be formed by expansion of one tubular within another. Thus, in the present invention, it is preferred that, at least at the overlapping portions of the tubulars where a coupling is to be formed, the second tubular has at least one of a lower yield strength or a higher modulus of elasticity than the first tubular.

Preferably, the second tubular is expanded by an expansion cone or mandrel, or alternatively by a roller expansion tool such as that described in Applicant's international patent applications publication numbers WO00/37766, WO00/37772, or WO03/048503, and which tools may define a fixed diameter or which may be compliant. In other embodiments other expansion tools and techniques may be utilised, including use of inflatable bladders or by direct application of differential fluid pressure across the wall of the tubular.

Advantageously, the second tubular may be translated by pulling from above. For example, the second tubular may be mounted on a running string which extends from surface level, wherein the running string is used to pull the second tubular in an upward direction. Alternatively, the second tubular may be translated by applying a translating force from below. Rather than or in addition to mechanical forces, fluid pressure may be utilised to translate the second tubular relative to the first tubular.

Preferably, an upper end portion of the second tubular is not expanded, or at least not expanded to the same extent as the expanded portion. Advantageously, the second tubular comprises a frangible region between the upper portion thereof and the expanded portion. The frangible region may be formed by a circumferential notch or notches or the like, or by treating or modifying the region, for example by heat treatment, to create a region which facilitates separation of the upper end portion. Details of examples of techniques for creating such frangible regions may be found in applicant's U.S. Pat. No. 6,629,567 and US published patent application no 2003/0062171, the disclosures of which are incorporated herein by reference. Conveniently, once the interference coupling between the first and second tubulars is established, the upper portion of the second tubular may be separated through the frangible region, such that a tubing string having a substantially constant inner diameter is formed.

The upper portion of the second tubular may be separated therefrom by, for example, running an expansion tool across the frangible region, or by exerting a tensile force on the second tubular sufficient to cause tensile failure at the frangible region. In other embodiments the separation of the upper portion may be achieved by use of a cutting tool. Alternatively, the upper portion end portion of the second tubular may also be expanded, such that there is no requirement for separation. The expansion of the upper end portion of the second tubular may result in simultaneous expansion of the surrounding portion of the first tubular.

The method according to the sixth aspect may further include the step of injecting cement into an annulus formed between the first tubular and the bore wall. The cement may be injected before or after the second tubular is located within the bore.

In one embodiment, the annulus between the bore wall and the lower portion of the first tubular may be substantially filled with a compressible material, such as a compressible cement, which will accommodate expansion of the lower portion, while sealing the bore.

Advantageously, cement may be at least partially excluded from a volume surrounding the lower portion of the first tubular, at least until the interference coupling is established between the first and second tubulars. Cement exclusion may be achieved by the use of a specifically adapted expandable tubing arrangement which includes cement exclusion means for preventing or restricting cement access to the area around the lower portion of the first tubular. Such an arrangement is disclosed in Applicant's international patent application publication number WO02/25056, the disclosure of which is incorporated herein by reference.

The lower end of the first tubular may comprise an expandable body portion defining an inner diameter and an outer diameter, wherein the body portion is adapted to be expanded to increase the inner diameter while substantially maintaining the outer diameter. In this way, the inner diameter of the lower portion of the first tubular may be expanded when the outer diameter is circumferentially, or radially, restrained, by cement or the bore wall or the like. The first tubular may be a tubular according to the third aspect. Thus, the annulus formed between the first tubular and the bore wall may be completely filled with cement, such that when the second portion is translated to establish the interference coupling, the inner diameter of the body portion may still be expanded to accommodate the expanded portion of the second tubular, while the outer diameter of the body portion is restrained from expansion due to the cement within the annulus.

The method may further comprise the step of injecting cement into an annulus formed between the second tubular and the bore wall. The cement is preferably injected after the interference coupling is established.

In one embodiment of the present invention, the first tubular may be located within a bottom or end portion of the bore, with the method further comprising the step of extending the depth of the bore by drilling, and then locating the second tubular within the extended portion of the bore, or by drilling and simultaneously advancing the second tubular into the bore. Alternatively, the bore may be of a depth to accommodate both first and second tubulars prior to locating the first tubular within the bore.

Preferably, the bore is a well bore, and more preferably a well bore for use in the extraction of hydrocarbons from an underground formation.

Each tubular may comprise a single tube or pipe or the like or may alternatively comprise a string of tubes or pipes or the like connected together, end to end. Advantageously, the tubular may be a casing string or alternatively a liner string. In other embodiments, one or more tubulars may include a sand-screen or completion component, which may or may not be expandable.

According to a seventh aspect of the present invention, there is provided a method of anchoring a tubular within a bore, said method comprising the steps of:

locating a tubular within a bore having first and second sections, the first section defining an inner diameter and the tubular being located such that at least a portion thereof extends beyond the first section of the bore;

expanding said portion of the second tubular to define an expanded portion describing an outer diameter greater than the inner diameter of the first section of the bore; and translating the tubular to move at least part of the expanded portion into the first section to expand said first section and create an interference coupling therebetween.

The first section of the bore may be defined by an open or unlined bore. Alternatively, the first section may be defined by a further tubular.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1A:
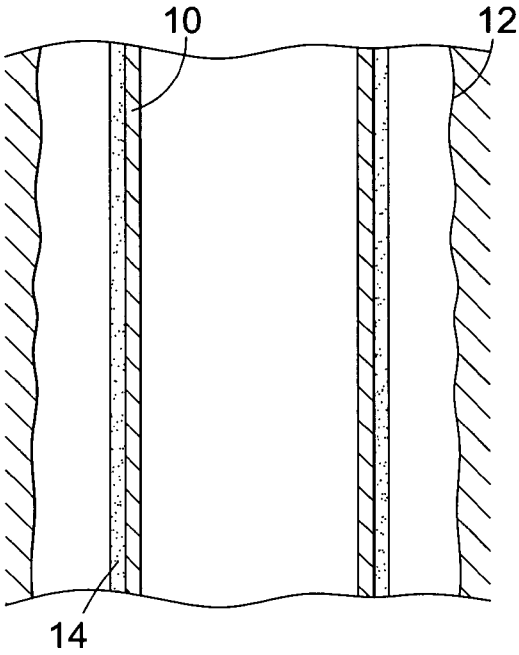
FIGS. 1A, 1B and 1C are diagrammatic representations of stages of locating and sealing a tubular within a well bore in accordance with an embodiment of an aspect of the present invention.
Figure 1B:
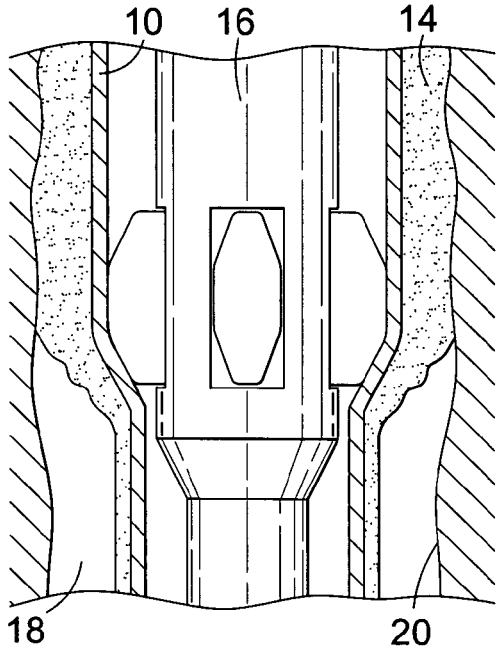
Figure 1C:
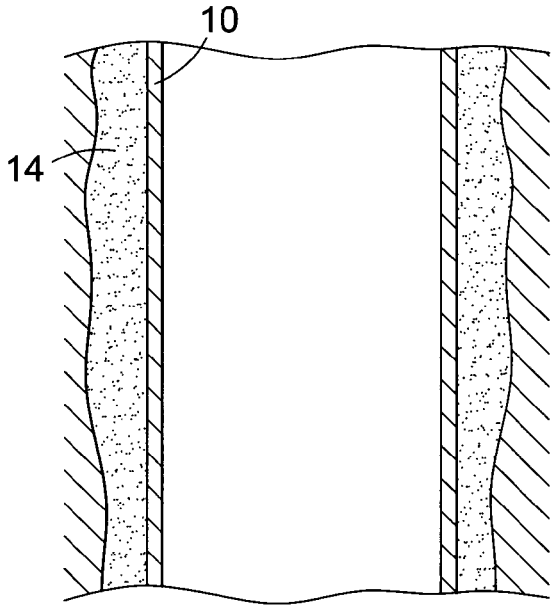

Referring initially to FIG. 1A, an expandable tubular casing string 10, shown in cross-section, is located in a previously drilled well bore 12. The tubular 10 includes an expandable, enlargeable or swelling material 14 located on the outer surface thereof, wherein the material 14 is capable of expanding in volume or swelling when activated by an appropriate stimulant, as described below. Once the tubular 10 is located in the correct position within the bore 12, the tubular is expanded to define a larger diameter using, in the illustrated embodiment, a roller expansion tool 16, as shown in FIG. 1B. The heat generated by the working of the metal of the tubular 10 during the expansion process induces the material 14 to swell and entirely fill the annulus 18 defined between the tubular 10 and the wall surface 20 of the bore 12, as also shown in FIG. 1C. The combined expansion of the tubular 10 and the material 14 along the length of the tubular 10 allows the fluid in the annulus 18 to be displaced, facilitating provision of a seal between the expanded material 14 and the bore wall. Thus, the expanded material 14 acts to seal the annulus 18.

Figure 2:
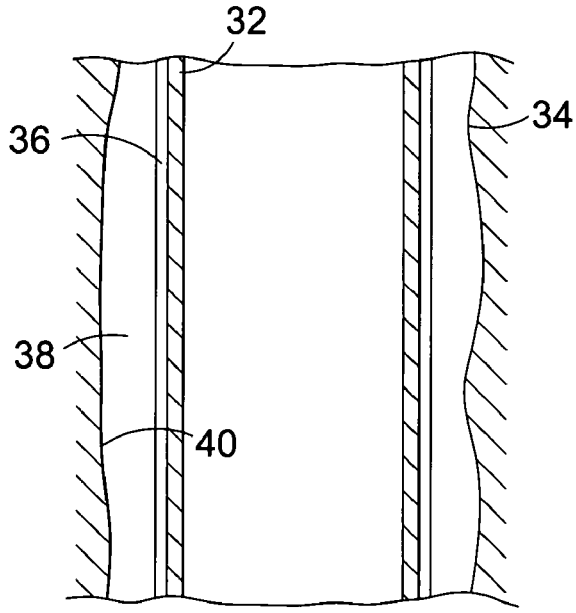
FIG. 2 is a diagrammatic representation of locating and sealing a tubular within a well bore in accordance with an alternative embodiment of the present invention.

Referring now to FIG. 2, an alternative method of sealing a bore is shown in which a tubular 32 is provided and located in a well bore 34, and includes a reactive material or hardener 36 on the outer surface thereof. The hardener 36 is selected to react with a fluid located within the annulus 38 between the bore wall 40 and the tubular 32 to cause the fluid to set or harden and thus provide a seal. The tubular 32 may be expanded before or after the fluid within the annulus has set.

Figure 3:
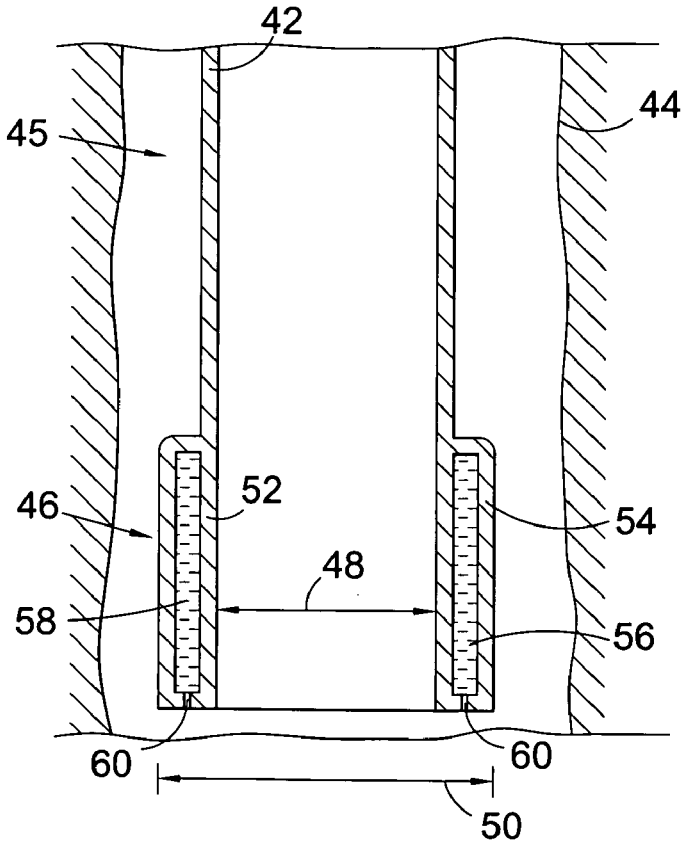
FIG. 3 is a cross-sectional view of a tubular in accordance with an embodiment of an aspect of the present invention, located in a bore.

Reference is now made to FIG. 3 in which there is shown a cross-sectional view of an expandable tubular 42, shown located in a well bore 44, in accordance with an embodiment of an aspect of the present invention. The tubular 42 comprises a tube portion 45 and a body portion 46, wherein the body portion defines an inner diameter 48 and an outer diameter 50, and is adapted to be expanded to increase the inner diameter 48 while substantially maintaining the outer diameter 50, as will be described below. In the embodiment shown, the body portion 46 is located at an end portion of the tubular 42.

The body portion 46 comprises an inner wall 52 and an outer wall 54, the walls 52, 54 being concentrically aligned and being separated by an annular chamber 56 defined therebetween. The inner diameter of the inner wall 52 is substantially equal to the inner diameter of the tube portion 45, and the outer diameter of the outer wall 54 is greater than the outer diameter of the tube portion 45.

The annular chamber 56 is filled with a substantially incompressible fluid 58, such as mineral oil, in order to provide a means to expand the inner and outer walls 52, 54 simultaneously. That is, as the inner wall 52 is expanded with an expansion tool, the fluid transmits the radial forces to the outer wall 54 to be expanded. A plurality of discharge ports 60 are provided in the body portion 46, the ports 60 allowing the fluid 58 to be discharged from the chamber 56 when a predetermined fluid pressure is reached during an expansion process. Further expansion of the inner wall 52 is therefore achievable when the fluid 58 is discharged, collapsing the chamber 56 while substantially maintaining the outer diameter of the outer wall 54.

Figure 4A:
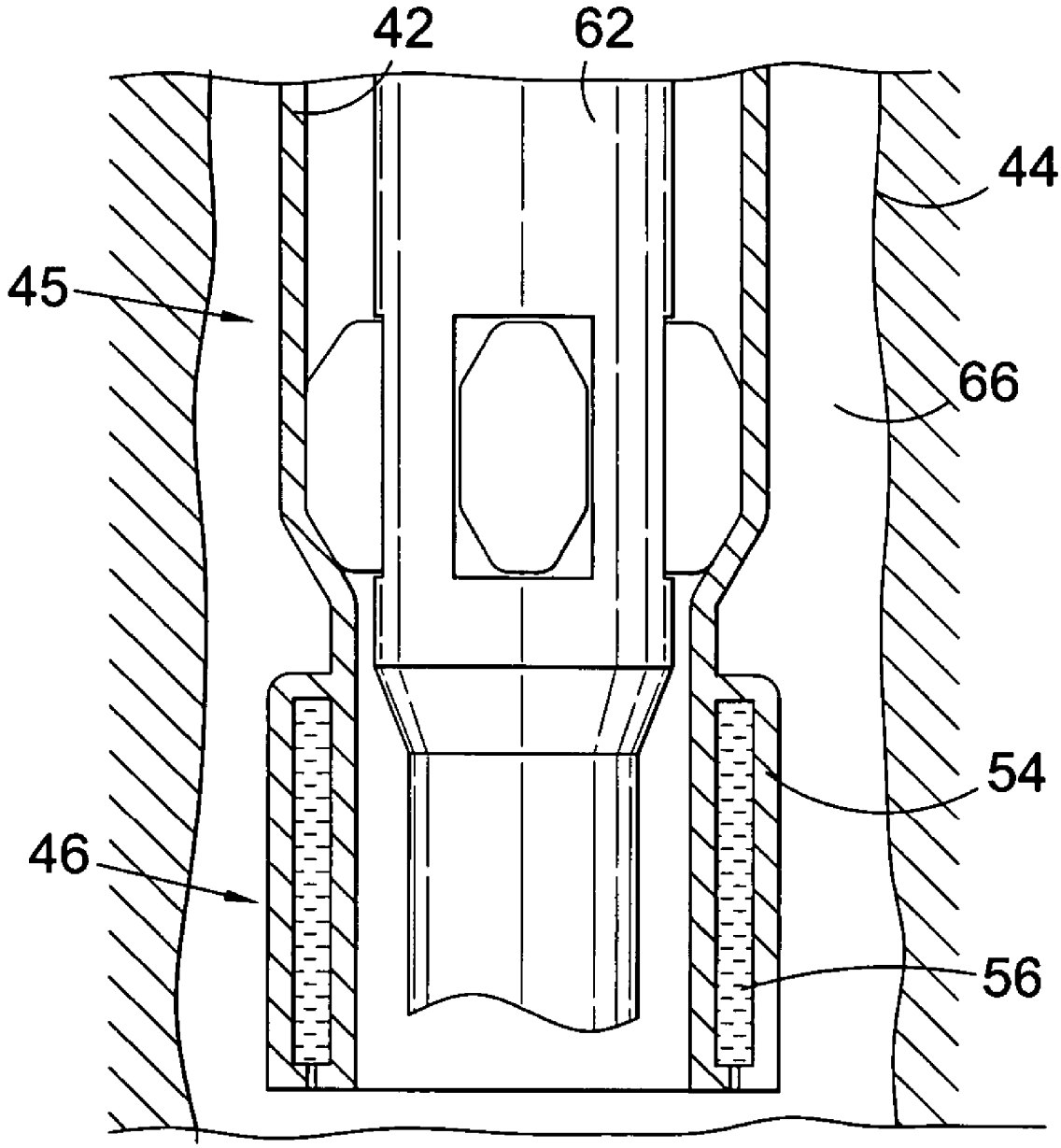
FIGS. 4A, 4B and 4C are diagrammatic representations of stages of securing and sealing the tubular of FIG. 3 in a well bore in accordance with an embodiment of the present invention.
Figure 4B:
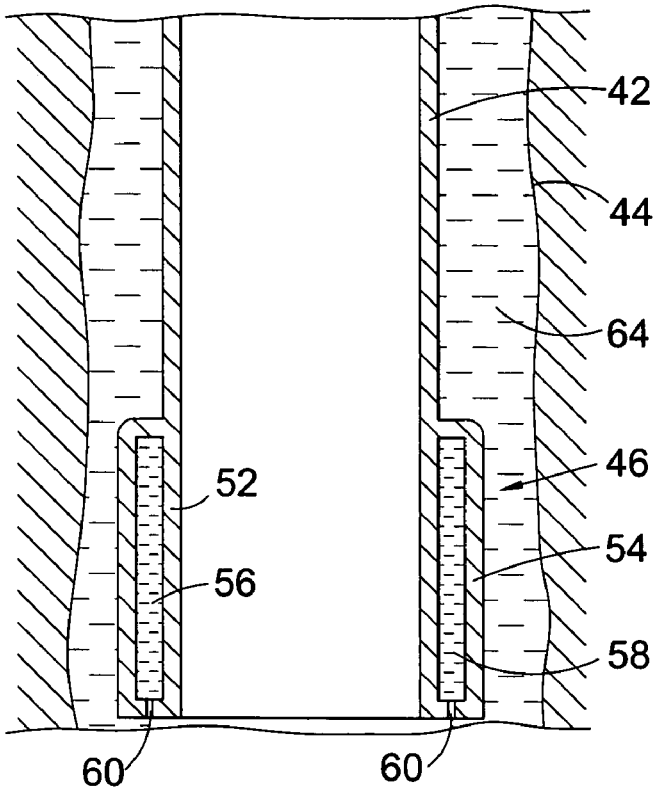

A more detailed description of expanding and sealing the tubular 42 shown in FIG. 3 in a well bore 44 will now be given with reference to FIGS. 4A, 4B and 4C. Referring first to FIG. 4A, the tubular 42 is located in the bore 44 and, in the illustrated embodiment, is radially expanded using a rotary expansion tool 62. Both the tube portion 45 and the body portion 46 of the tubular 42 are expanded initially, with the fluid within the annular chamber 56 transmitting the radial expansion forces to the outer wall 54 of the body portion to cause the outer wall to be expanded. Once the tubular 42 has been expanded, the expansion tool 62 is removed and a cement slurry 64 is injected into the annulus 66 formed between the tubular 42 and the well bore 44, as shown in FIG. 4B. Where an incompressible cement is used and has set, further expansion to increase the outer diameter of the tubular 42 will be extremely difficult, if not impossible. However, due to the form of the body portion 46, the inner wall 52 may be radially expanded into the chamber 56. This is achieved by inserting an expansion tool into the tubular 42 and activating the tool to expand the inner wall 52. Since the outer wall 54 is braced against the cement 64, the force of the expansion tool on the inner wall 52 will cause the pressure of the fluid 58 within the chamber 56 to increase beyond the predetermined opening pressure of the discharge ports 60, thus causing the fluid 58 to be vented, allowing the inner wall 52 to be expanded and collapse the chamber 56.

Figure 4C:
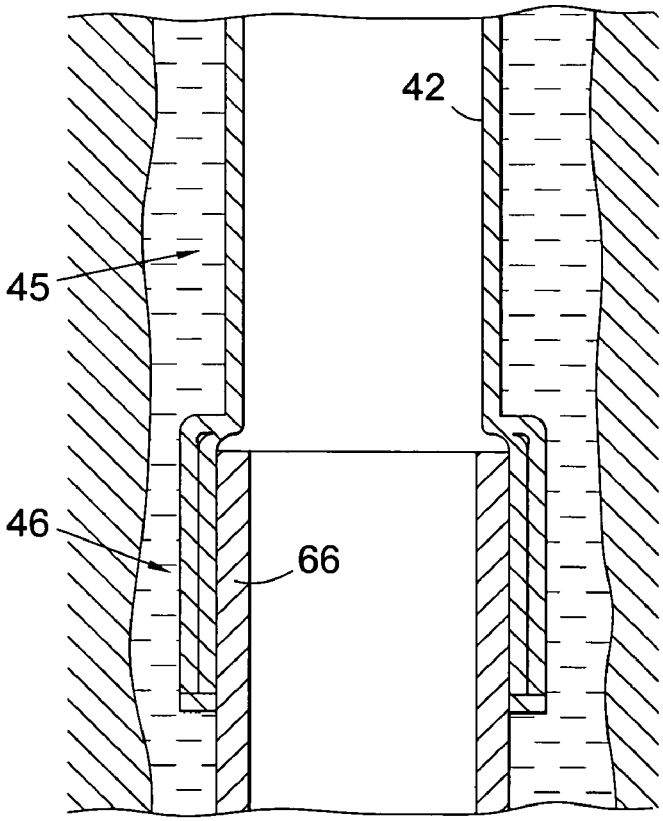

Once the inner wall has been expanded, the resulting body portion 46 will be in the form of a belled end, as shown in FIG. 4C, wherein the inner and outer diameters of the expanded body portion are larger than the respective inner and outer diameters of the tube portion 45. The ability to expand the inner wall 52 when the outer wall 54 is restrained is particularly advantageous where a further tubular 66, shown in FIG. 4C, is required to be hung or supported from tubular 42. In this case, the further tubular 66 is expanded into the belied end of tubular 42 so that the resulting internal bore defined by both tubulars 42, 66 is substantially uniform.

In other embodiments the expansion of the further tubular 66 may be utilised to expand the inner wall 52 and collapse the chamber 56, such that the belled end is not created until the further tubular 66 is in place in the bore and has been expanded.

Figure 5A:
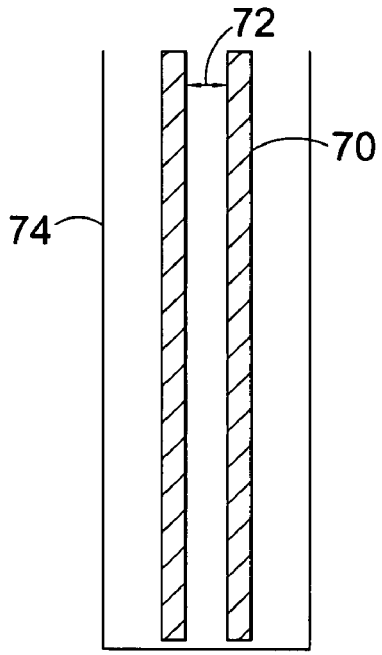
FIGS. 5A to 5H are diagrammatic representations of stages of a method of producing a lined bore in accordance with an embodiment of an aspect of the present invention.
Figure 5B:
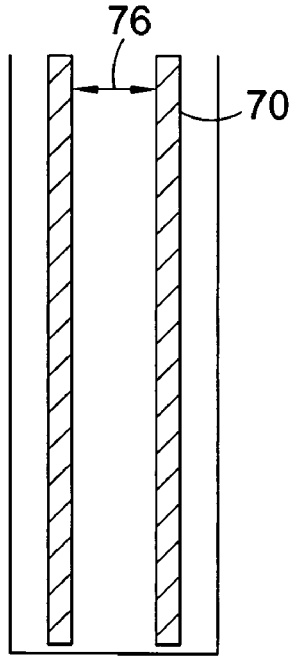
Figure 5C:
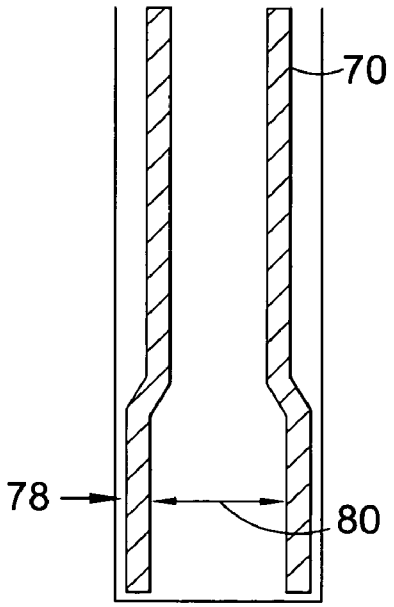
Figure 5D:
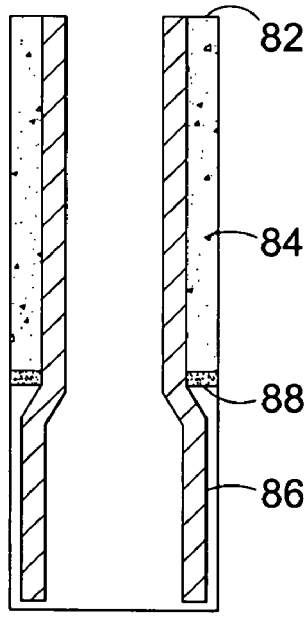
Figure 5E:
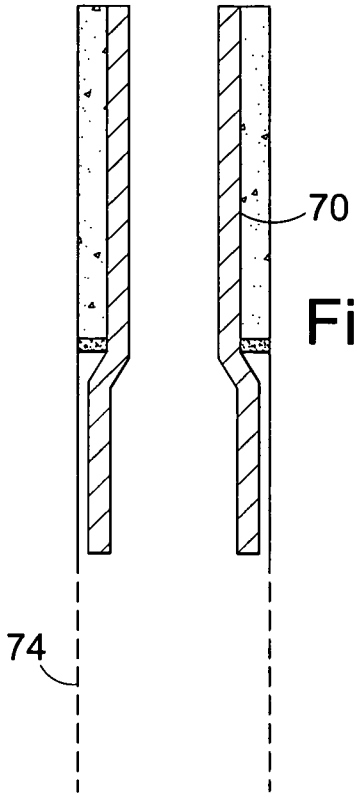
Figure 5F:
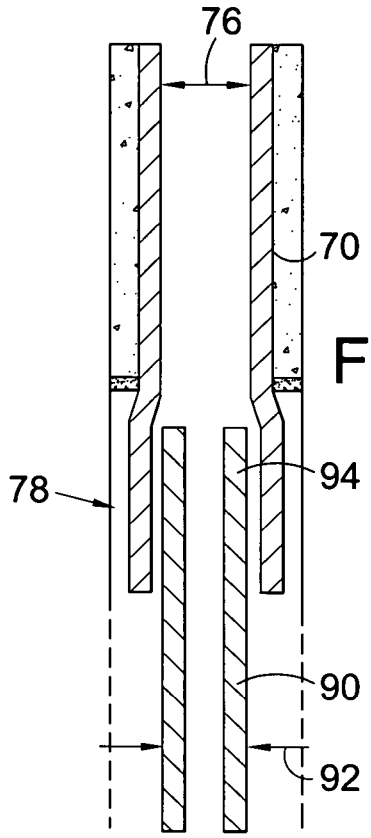
Figure 5G:
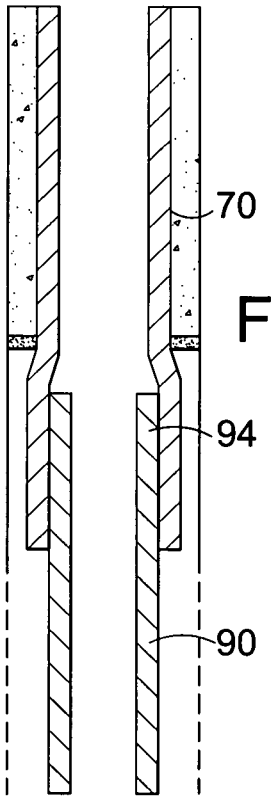
Figure 5H:
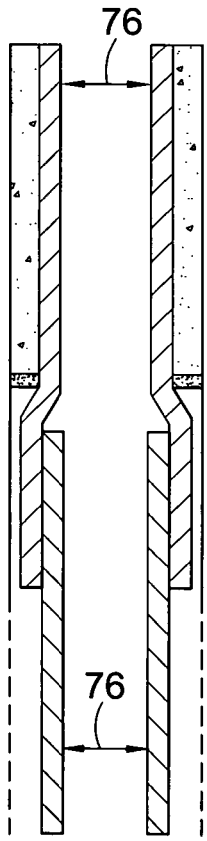

Reference is now made to FIGS. 5A to 5H in which there is shown a diagrammatic representation of steps in a method of producing a lined bore. Referring firstly to FIG. 5A, an expandable first tubular 70 having a first diameter 72 is located within a drilled bore 74. The first tubular 70 is then expanded to define a second inner diameter 76, as shown in FIG. 5B. Expansion may be achieved by any appropriate means, including cone or mandrel expansion, roller expansion, hydraulic expansion, or a combination of one or more different expansion mechanisms. Following this, a lower portion or shoe 78 of the first tubular 70 is further expanded to define a third diameter 80, as illustrated in FIG. 5C. FIG. 5D shows an optional step in the method in which an annulus 82 formed between the tubular 70 and bore 74 is filled with cement 84. As shown, cement is excluded from the annulus region 86 formed around the shoe 78, by use of cement exclusion swabs or members 88. The following step, shown in FIG. 5E, involves drilling further to extend the depth of the bore 74 below the first tubular 70. Once the bore 74 has been extended to the required depth, an expandable second tubular 90, having an outer diameter 92 less than the second diameter 76 of the first tubular 70, is run into the bore 74, through the first tubular 70, as shown in FIG. 5F. The second tubular 90 is located such that an upper portion 94 thereof overlaps the lower portion or shoe 78 of the first tubular 70. Following this, the second tubular 90 is expanded until the upper portion 94 thereof engages the shoe 78 of the first tubular 70, as shown in FIG. 5G. The second tubular 90 is then further expanded, such that the shoe 78 of the first tubular 70 is also further expanded, as shown in FIG. 5H. Thus, the method represented in FIGS. 5A to 5H produces a lined bore wherein the tubulars 70,90 define a substantially constant inner bore diameter, substantially equal to the second diameter 76. Although not shown, the method may involve the further step of cementing the second tubular 90 in place.

The method shown in FIGS. 5A to 5H may be repeated, as required, to continually extend the depth of the bore. For example, the lower end of the second tubular may be expanded to define the third diameter 80, with an expandable third tubular being run in and expanded in a similar fashion as shown in FIGS. 5G and 5H. In alternative embodiments a first tubular may be provided with an initial form as illustrated in FIGS. 5C-5E.

Figure 6:
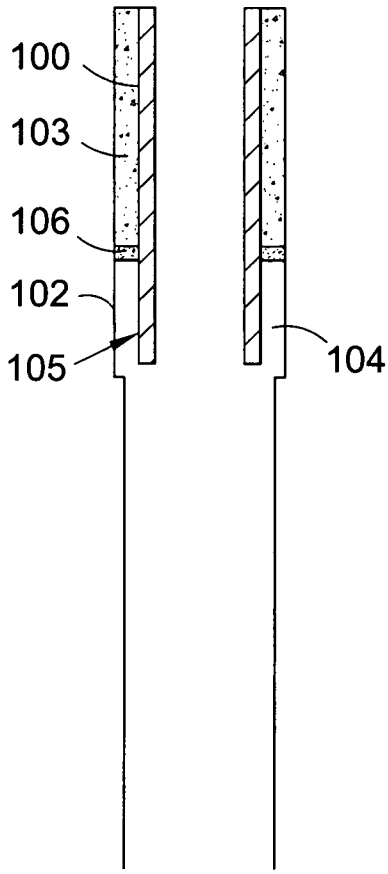
FIGS. 6 to 12 are diagrammatic representations of a method of coupling tubulars within a bore in accordance with various embodiments of an aspect of the present invention.

Embodiments of a method of coupling tubulars within a bore according to an aspect of the present invention will now be described with reference to FIGS. 6 to 12. Reference is first made to FIG. 6, in which a first tubular 100 is shown located and cemented within a bore 102, the cement being represented by reference numeral 103. As shown, cement 103 is excluded from the annulus 104 formed around the lower portion or shoe 105 of the first tubular. Cement exclusion may be achieved through use of a tubing shoe apparatus which includes cement outlets in a wall surface thereof to allow cement to enter the annulus above the shoe, and further comprises cement exclusion members 106 for preventing downward movement of the cement. Such a tubing shoe apparatus is disclosed in Applicant's WO02/25056, as are other shoe or tube forms which may be utilised to achieve this effect.

Figure 7A:
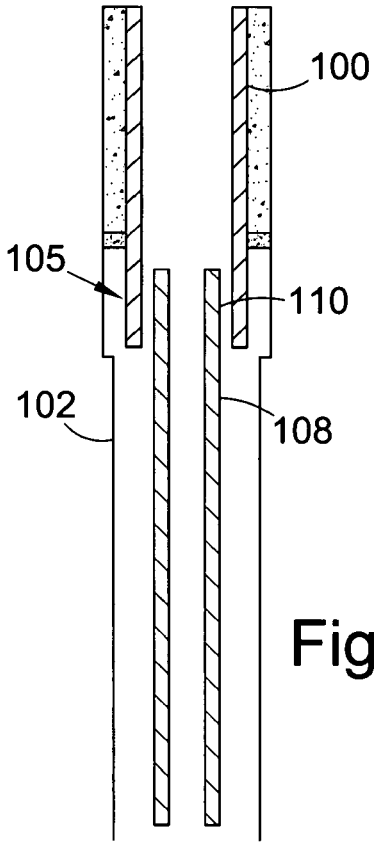
Figure 7B:
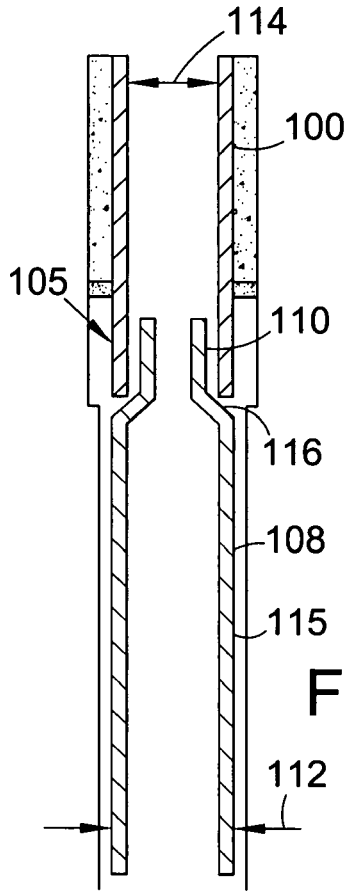
Figure 7C:
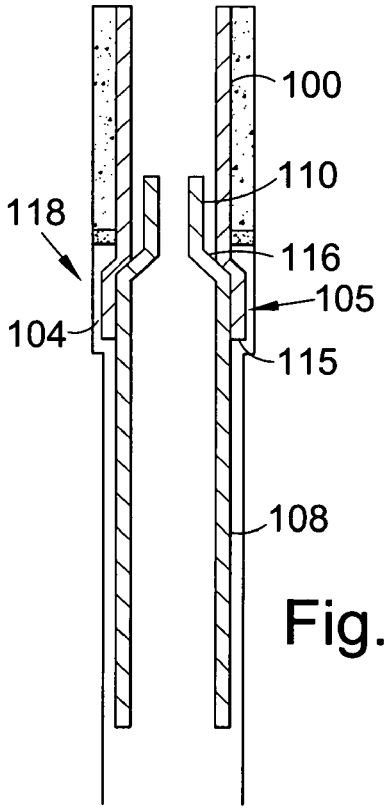

Once the first tubular 100 is adequately located within the bore 102, an expandable second tubular 108 is run in until the upper portion 110 overlaps the shoe 105 of the first tubular 100, as shown in FIG. 7A. Although not shown, the second tubular is run into the bore 102 on a suitable running string. With reference now to FIG. 7B, a section 115 of the second tubular 108 extending below the first tubular 100 is expanded to define an outer diameter 112 which is greater than the inner diameter 114 of the first tubular 100. Accordingly, the upper, overlapping portion 110 of the second tubular remains substantially unexpanded. For reasons which will become apparent hereinafter, the second tubular defines a frangible region 116 between the expanded and non-expanded portions 115, 110 thereof. Once sufficient expansion of the second tubular 108 is achieved, the second tubular 108 is then translated upwardly with respect to the first tubular 100, by pulling from surface level via the running string (not shown), such that the expanded portion 115 is moved into the shoe 105, as shown in FIG. 7C. In this way, an interference coupling 118 between the first and second tubulars 100,108 is established. This interference coupling 118 is generally termed a tubing hanger. As shown in FIG. 7C, the shoe 105 of the first tubular 100 is expanded by the second tubular 108, the expansion being permitted due to the exclusion of cement from annulus 104. Thus, the inherent elastic recovery of the resulting expanded shoe 105 will act to grip the second tubular 108, thus creating an enhanced interference coupling 118. Furthermore, any deformation of the second tubular 108 caused by radially compressive forces will cause elastic recovery thereof to further enhance the coupling 118.

Creation of a secure coupling 118 may be enhanced by following the teaching of applicant's WO 03/048521, that is by forming the shoe 105 of a material having a higher yield strength or lower modulus of elasticity than the tubular 108, or by providing a band or bands of material of higher yield strength or lower elastic modulus around the shoe 105.

Figure 7D:
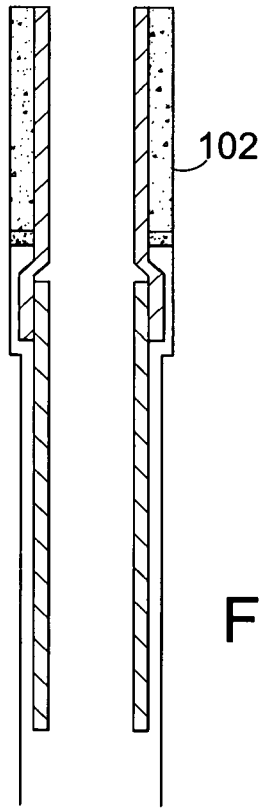

Once a sufficient coupling 118 is achieved, the unexpanded portion 110 of the second tubular may be separated through the frangible region 116, or simply cut away, such that a tubing string having a substantially constant inner diameter is provided, as shown in FIG. 7D. Although not shown, the expanded portion 110 may be separated by running an expansion tool across the frangible region 116, or by exerting a tensile force on the second tubular 108 sufficient to cause tensile failure at the frangible region 116. The separated unexpanded portion 110 may be removed from the bore 102 by the running string (not shown). In other embodiments the unexpanded portion 110 may be subsequently expanded, or may be milled away.

Although not shown, the method may involve the further step of cementing the second tubular 108 in place within the bore.

As noted above, exclusion of cement from annulus 104 permits expansion of the shoe 105 of the first tubular. This effect may, however, be achieved while still providing a sealing material in the annulus 104, as described below with reference to alternative embodiments of the present invention. It should be noted that reference numerals used in FIGS. 6 and 7A to 7D are used in the following description to represent like components.

Figure 8:
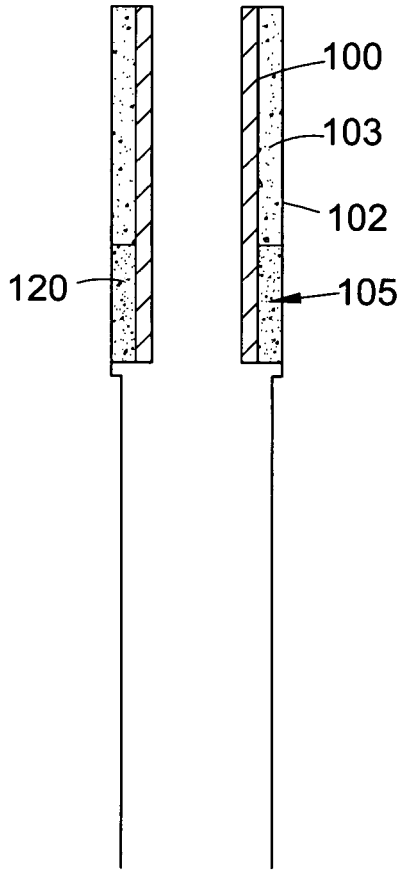
Figure 9:
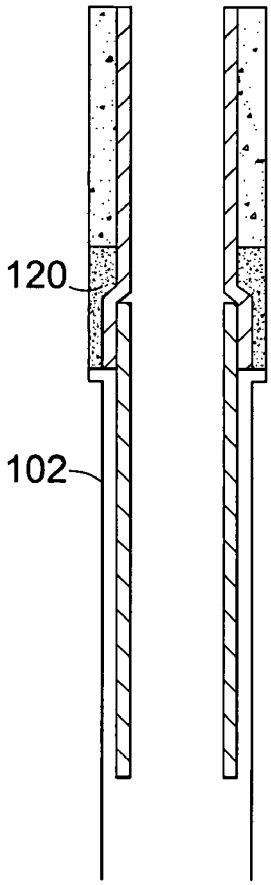
Figure 10:
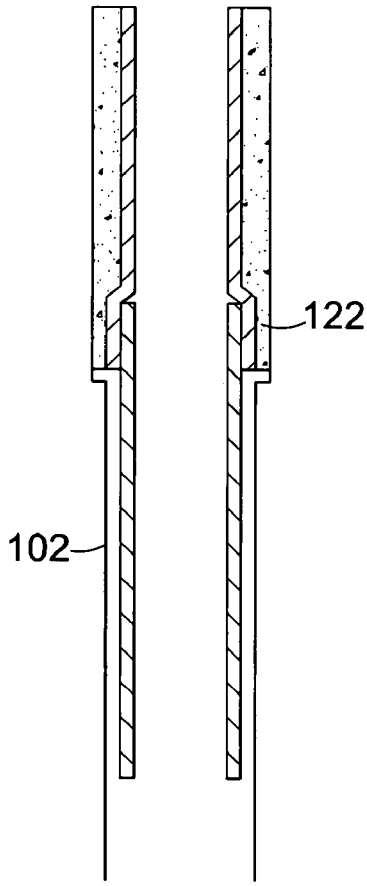

Referring to FIG. 8, a first tubular 100 is cemented in a bore 102 with a suitable settable material, which may be a conventional cement 103. However, the annulus 104 formed around the lower portion or shoe 105 of the first tubular 100 is filled with a compressible material 120. The material 120 may be an elastomeric material, foam, or alternatively may be a compressible cement. Thus, carrying out the steps shown in FIGS. 7A to 7D will produce a section of lined bore 102 as shown in FIG. 9 using a generally compressible material 120, or as shown in FIG. 10 using a compressible cement 122.

Figure 11:
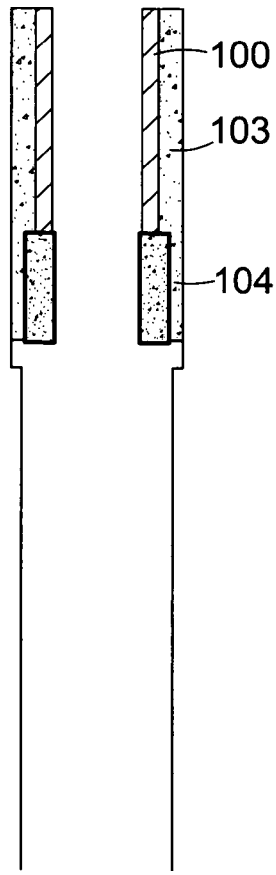
Figure 12:
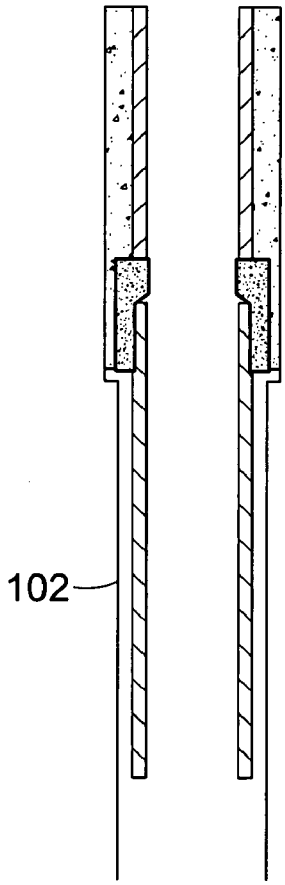

An alternative arrangement is shown in FIG. 11, in which the lower portion or shoe 105 of the first tubular is formed by the body portion 46 as shown in FIG. 3. Thus, the annulus 104 may be filled with cement 103, prior to carrying out the steps shown in FIGS. 7A to 7D. The resulting lined bore is shown in FIG. 12.

Figure 13A:
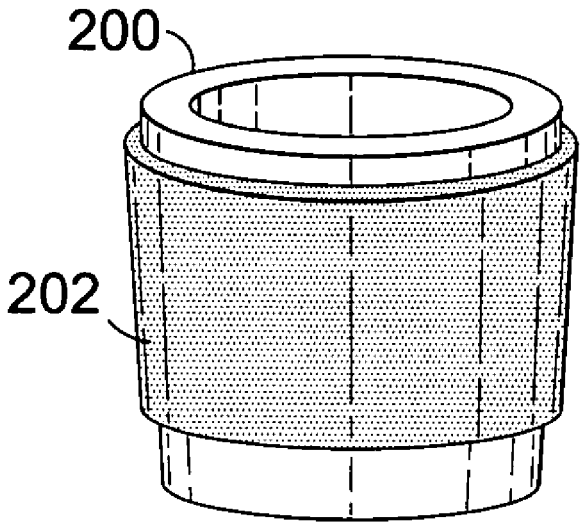
FIG. 13A is a perspective view of an activatable sealing medium in the form of a sealing member in accordance with an embodiment of an aspect of the present invention.

Reference is now made to FIG. 13A of the drawings, which is a perspective view of an activatable sealing medium in the form of a sealing member 200 in accordance with an embodiment of an aspect of the present invention. The sealing member 200 is in the form of a ring biased to assume a frusto-conical configuration, but is initially restrained in a near cylindrical configuration by a retaining member 202. The retaining member 202 is in the form of a band of swelling elastomer which, on exposure to selected fluids, absorbs the fluids and weakens, allowing the sealing member 200 to expand to assume a frusto-conical configuration.

Figure 14A:
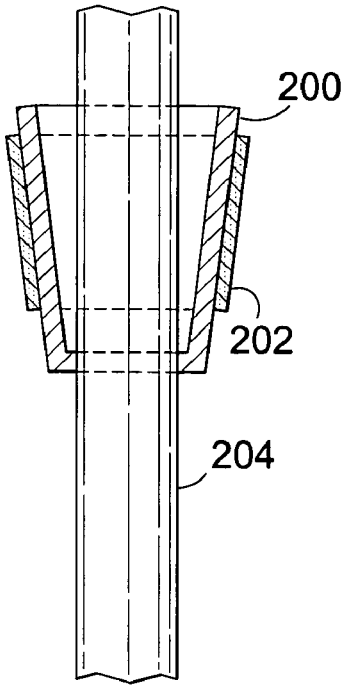
FIGS. 14A and 14B are diagrammatic sectional views of the sealing member of FIG. 13 on a tubular.
Figure 14B:
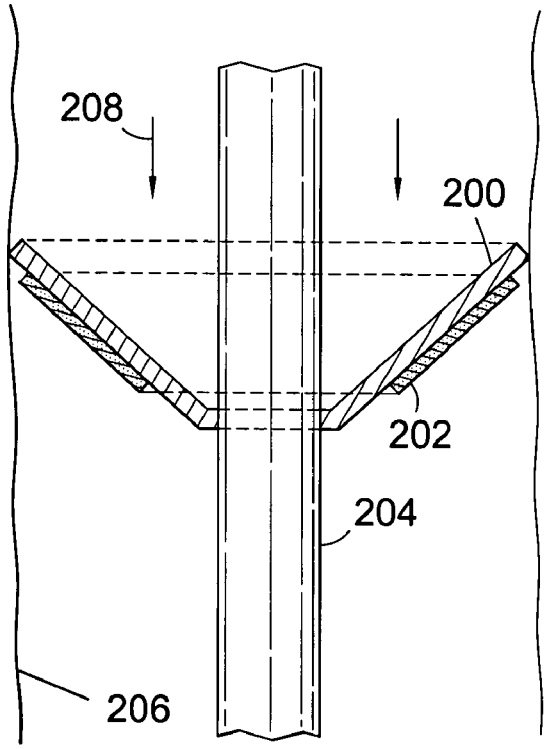

Reference is now made to FIGS. 14A and 14B of the drawings, which show the sealing member 200 provided on a tubular 204. FIG. 14A shows the tubular 204 and the sealing member 200 in a configuration ready to be run into a bore. On being run into a bore 206, as illustrated in FIG. 14B, the retaining member 202 is exposed to fluids which are absorbed by the material of the retaining member 202, and which cause the material to weaken, allowing the sealing member 200 to assume its frusto-conical configuration. The sealing member 200 is configured such that, on reaching its expanded configuration, the free end of the sealing member engages the wall of the bore 206 to provide at least a partial seal therebetween. As will be recognised by those of skill in the art, this seal configuration has been provided in order to resist pressure from the direction of arrows 208.

Figure 13B:
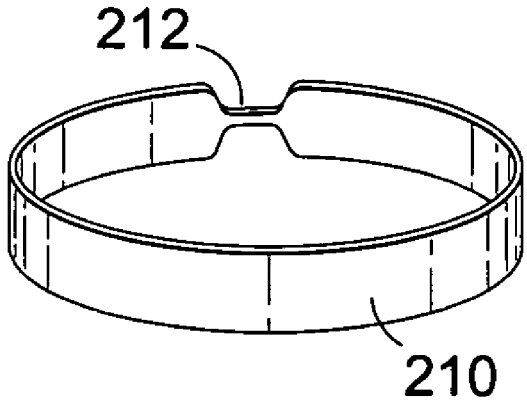
FIG. 13B is a perspective view of an alternative retaining member for the sealing member of FIG. 13A.

Reference is now made to FIG. 13B of the drawings, which is a perspective view of an alternative retaining member 210 for use with the sealing member 200. The retaining member 210 is in the form of a band having a reduced thickness section 212. In use, the retaining member 210 is used to restrain the sealing member 200 in an initial configuration, until a tubular carrying the sealing member 200 is run into the desired location in a drilled bore. If the tubular, and the sealing member 200, are then subject to expansion, the retaining member 210 will fail at the reduced thickness section 212, and the unrestrained sealing member 200 may then extend to assume the desired frusto-conical configuration. In other embodiments the retaining member may be frangible, soluble or extend on exposure to heat.

Figure 15A:
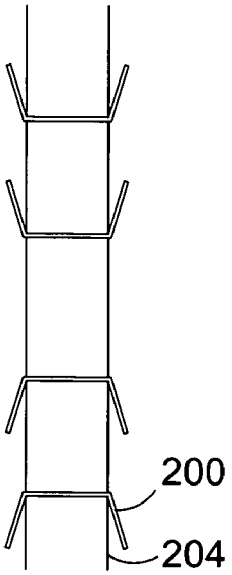
FIGS. 15A and 15B are diagrammatic views of a number of the sealing members of FIG. 13 on a tubular.
Figure 15B:
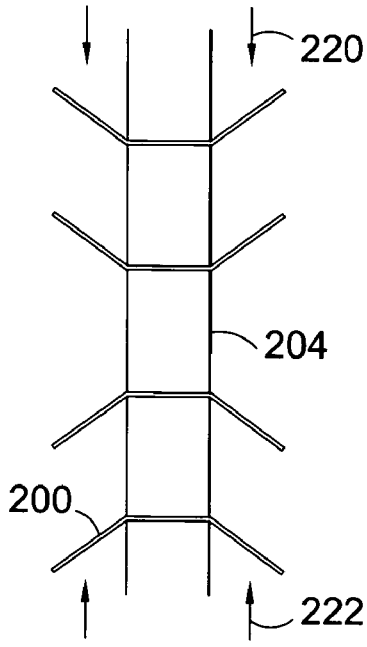

Reference is now made to FIGS. 15A and 15B of the drawings, which illustrate a number of the sealing members 200 on a tubular 204. In particular, in this example, four sealing members 200 are illustrated, two of the sealing members 200 being configured to resist pressure from the direction of arrows 220, and the two other sealing members 200 being configured to resist pressure from the opposite direction, as illustrated by arrows 222.

Figure 16A:
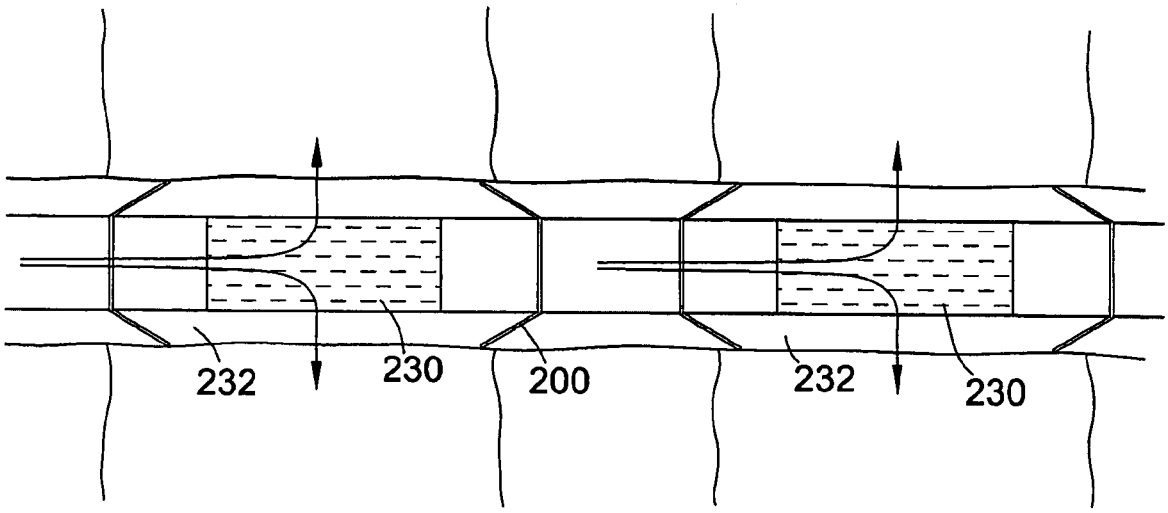
FIGS. 16A and 16B are diagrammatic views of different applications of sealing members of FIG. 13A.

Reference is now made to FIG. 16A of the drawings, which illustrates use of four sealing members 200 in an injection well, where injection fluid is being directed into two spaced formations, via respective slotted or apertured tubular sections 230 and annulus sections 232. One or more sealing members 200 are positioned at an end of each slotted tubular section 230, and each sealing member is configured to hold the higher fluid pressure seen in each injection annulus 232.

Figure 16B:
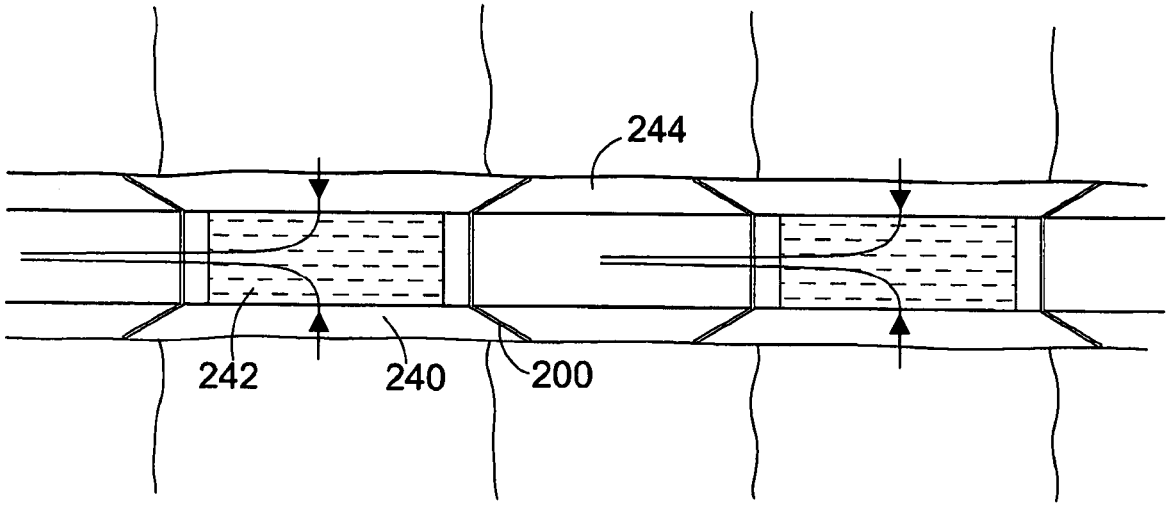

In FIG. 16B of the drawings, sealing members 200 have been provided in a production well, in which production fluid flows from formations into a tubular, via a respective annulus 240 and section of slotted tubing 242. As the fluid pressure in the annulus 240 around each slotted tubing section 242 is likely to be lower than the pressure in an adjacent section of the annulus 244, the sealing members 220 are in the opposite configuration to those shown in FIG. 16A.

Figure 17A:
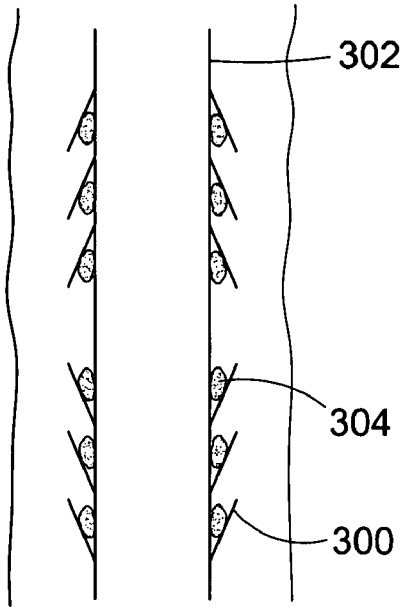
FIGS. 17A and 17B, and FIGS. 18A and 18B, illustrate sealing members in accordance with further embodiments of an aspect of the present invention.
Figure 17B:
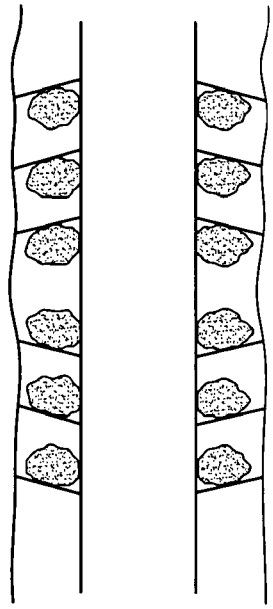

Reference is now made to FIGS. 17A and 17B of the drawings, which illustrate sealing members in accordance with a still further embodiment of an aspect of the present invention. In this embodiment, the plurality of sealing members 300 are mounted on a tubular 302. The sealing members 300 normally lie adjacent to the outer surface of the tubular 302, with one end of the sealing member being fixed to the tubular 302 and the other end being free. An expandable material is provided between the tubular 302 and the sealing member 300, and on the material 304 expanding the sealing members 300 are caused to pivot outwardly from the tubular 302, to assume the configuration as illustrated in FIG. 17B.

Thus, it is possible to move the sealing members 300 to a sealing configuration in which the free ends of the sealing members engage with the surrounding bore wall, as illustrated in FIG. 17B.

The expanding material 304 may take any appropriate form, including a bi-component material which expands on exposure to heat created by, for example, the tubular 302 being diametrically expanded. Alternatively, the material 304 may expand on exposure to well fluids.

Figure 18A:
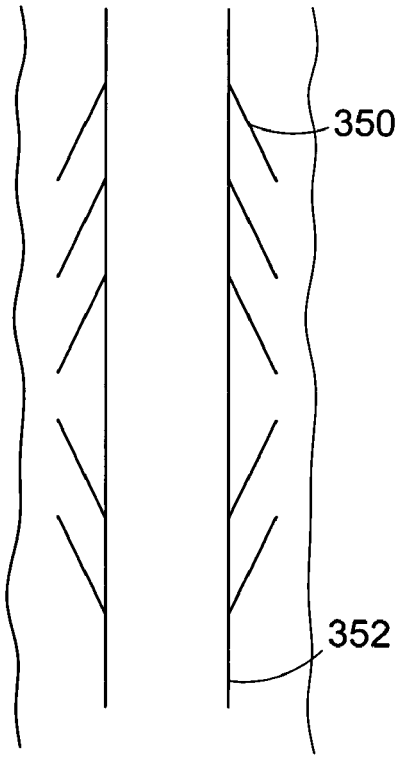
Figure 18B:
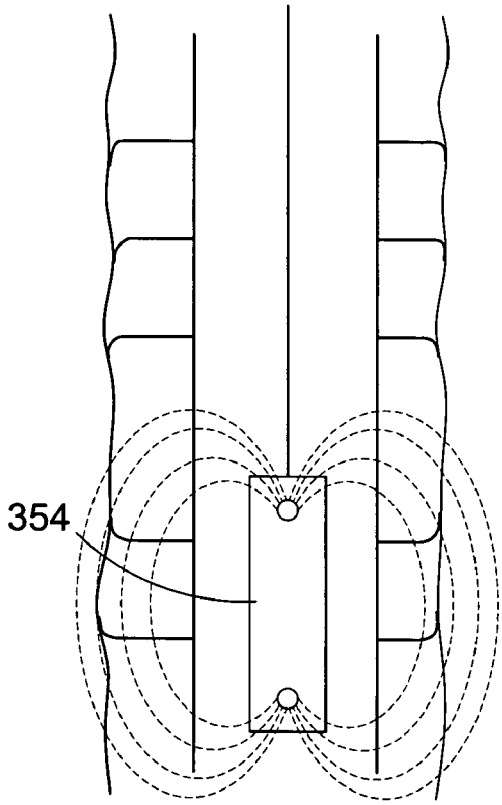

Reference is now made to FIGS. 18A and 18B of the drawings, which illustrate sealing members 350 mounted on a tubular 352. The sealing members 350 are somewhat similar to the sealing members 300 described above, however in this embodiment the sealing members 350 are adapted to move to a sealing configuration, as illustrated in FIG. 18B, by exposure to electromagnetic forces applied by an appropriate device 354. It should be understood that the embodiments described above are merely exemplary of aspects of the present invention and that various adaptations and modifications may be made to without departing from the scope of the invention. For example, the swelling material 14 in FIGS. 1A-1C may be induced to expand in volume upon contact with a specific fluid such as water, hydrocarbons, drilling fluid or the like. Additionally, the chamber 56 of the tubular shown in FIG. 3 may be empty of any fluid, or filled with compressible fluid, such that only the inner wall 52 will be expanded during an expansion process. Furthermore, the embodiments shown in the Figures show expansion being achieved using a roller or rotary expansion tool. It should be understood, however, that any suitable expansion tool or method commonly used in the art may be used.

While the above discussions have been made in relation to expandable tubulars, it should be understood that the sealing methods and arrangements disclosed may be utilised in combination with non-expandable tubulars.

Additionally, the above description has been given in relation to tubulars used downhole or in a borehole. It should be understood, however, that aspects of the present invention may be utilised at surface level and/or out with the confines of a borehole.

The invention claimed is:

1. A method of lining a bore, said method comprising the steps of:

locating a first tubular defining a first diameter within a bore;

expanding the first tubular to define a second diameter;

injecting cement into an annulus formed between the first tubular and a wall of the bore while at least partially excluding the cement being injected from a volume surrounding a lower portion of the first tubular;

further expanding the lower portion of the first tubular to define a third diameter, wherein the cement is at least partially excluded from the lower portion at least until the lower portion of the first tubular has been expanded to define the third diameter;

locating a second tubular defining a diameter less than the second diameter within the bore such that a portion of the second tubular overlaps the lower portion of the first tubular;

expanding the second tubular into engagement with the lower portion of the first tubular that has the third diameter; and further expanding beyond the third diameter at least part of the second tubular overlapping the lower portion of the first tubular.

2. The method of claim 1, wherein the cement is injected before the first tubular is expanded.

3. The method of claim 1, wherein the cement is injected after the first tubular is expanded.

4. The method of claim 1, wherein the cement is injected into the annulus after the lower end of the first tubular has been expanded to define the third diameter, but before the second tubular is run into the bore.

5. The method of claim 1, wherein the volume is substantially filled with a compressible material which is an elastomeric material or foam and will accommodate expansion of the lower portion, while sealing the bore.

6. The method of claim 1, further comprising the step of injecting cement into an annulus formed between the second tubular and the bore wall.

7. The method of claim 1, further comprising providing cement exclusion members around the first tubular to prevent movement of the cement into the volume while injecting the cement.

8. A method of lining a bore, comprising:

disposing a first tubing within a bore;

expanding the first tubing, wherein a bottom end of the first tubing is expanded more than a portion of the first tubing preceding the bottom end;

cementing the first tubing in the bore leaving an annulus around the bottom end of the first tubing without cement;

running a second tubing through the first tubing to position the second tubing overlapping the bottom end of the first tubing that is already expanded; and expanding the second tubing to cause further expansion of the bottom end of the first tubing.

9. The method of claim 8, further comprising drilling to extend depth of the bore beyond the first tubing.

10. The method of claim 8, wherein the first and second tubing post expansion define a common bore with a constant inner diameter.

11. The method of claim 8, wherein the second tubing extends from the first tubing into an extension of the bore beyond the first tubing.

12. The method of claim 8, further comprising providing cement exclusion members around the first tubing to facilitate leaving the annulus around the bottom end of the first tubing without cement.

13. The method of claim 8, wherein the annulus around the bottom end of the first tubing includes one of an elastomeric material and foam.

14. A method of lining a bore, comprising:

expanding a first tubing within the bore, wherein a section of the first tubing at a terminus where the first tubing opens to the bore is expanded more than other sections of the first tubing;

cementing the first tubing in the bore leaving an annulus around the section of the first tubing without cement by excluding injection of the cement into the annulus;

positioning a second tubing inside the first tubing after expanding the section of the first tubing more than the other sections of the first tubing; and expanding the second tubing while inside the first tubing.

15. The method of claim 14, further comprising drilling to form an extension of the bore beyond the first tubing cemented in the bore.

16. The method of claim 15, wherein the second tubing extends from the first tubing into the extension of the bore.

17. The method of claim 16, wherein the first and second tubing post expansion define a common bore with a constant inner diameter.

18. The method of claim 14, wherein expanding the second tubing while inside the first tubing further expands the first tubing.

19. The method of claim 14, wherein excluding injection of the cement into the annulus utilizes cement exclusion members around the first tubing.

20. The method of claim 14, wherein the annulus around the section of the first tubing without cement includes one of an elastomeric material and foam.

* * * * *